United States Patent [19]

Conrad

[11] Patent Number: 4,593,639

[45] Date of Patent: Jun. 10, 1986

[54] METHOD OF STRESS DISTRIBUTION IN A SAIL AND SAIL CONSTRUCTION

[75] Inventor: Peter G. Conrad, Old Lyme, Conn.

[73] Assignee: Sobstad Sailmakers, Inc., Old Saybrook, Conn.

[21] Appl. No.: 681,933

[22] Filed: Dec. 14, 1984

[51] Int. Cl.[4] ..... B63H 9/06

[52] U.S. Cl. ..... 114/103

[58] Field of Search ..... 114/39, 102, 103, 109

[56] References Cited

U.S. PATENT DOCUMENTS

| | | | |
|---|---|---|---|
| 3,756 | 9/1844 | Trail | 114/103 |
| 4,305 | 12/1845 | Maull | 114/103 |
| 30,694 | 11/1860 | Sands . | |
| 401,373 | 4/1889 | Roberts . | |
| 1,411,504 | 4/1922 | Monro | 114/103 |
| 2,378,877 | 6/1945 | Waller . | |
| 2,589,203 | 10/1949 | Nilsen . | |
| 3,174,453 | 3/1965 | Lemoigne | 114/103 |
| 3,602,180 | 8/1971 | Holmes | 114/107 |
| 3,611,649 | 10/1971 | Muller et al. . | |
| 3,626,886 | 2/1971 | Cafiero . | |
| 3,828,711 | 8/1974 | Russell | 114/103 |
| 3,903,826 | 9/1975 | Andersen . | |
| 3,954,076 | 5/1976 | Fracker | 114/103 |
| 4,041,653 | 8/1977 | Rain | 52/2 |
| 4,263,861 | 4/1981 | Vicard | 114/103 |
| 4,383,492 | 5/1983 | Harris et al. . | |
| 4,449,467 | 5/1984 | Hild et al. . | |
| 4,476,799 | 10/1984 | Bandy . | |

FOREIGN PATENT DOCUMENTS

| | | |
|---|---|---|
| 702469 | 1/1941 | Fed. Rep. of Germany . |
| 909899 | 3/1954 | Fed. Rep. of Germany . |
| 967484 | 11/1950 | France . |
| 563913 | 6/1957 | Italy . |
| 58-112895 | 7/1983 | Japan . |
| 1196756 | 7/1970 | United Kingdom . |
| 1314579 | 4/1973 | United Kingdom . |

*Primary Examiner*—Trygve M. Blix
*Assistant Examiner*—Stephen P. Avila
*Attorney, Agent, or Firm*—Fred A. Keire

[57] ABSTRACT

A method for constructing a sail or any pliable lifting surface where the lift for or the motive power therefor is wind and a sail as an article of manufacture.

21 Claims, 3 Drawing Figures

METHOD OF STRESS DISTRIBUTION IN A SAIL AND SAIL CONSTRUCTION

This invention relates to a method for constructing a sail or any pliable lifting surface where the lift for or the motive power therefor is wind. More particularly, this invention relates to a pliable lifting surface such as a sail which is used as a motive power for devices using air motion as the motive power; in particular, this invention relates to a sail as an article of manufacture.

Still further, this invention relates to a lifting surface which is of a pliant material where the wind shapes the lifting surface and in its restrained position provides the motive power to a conveyance such as a boat or a wind-driven machine such as a windmill, a power generator or the like.

Still further, this invention relates to a sail-driven boat such as a square-rigged sail-driven boat, a mono-hull keel boat, keel centerboard boat, centerboard boat, an outrigger type boat, a catamaran, trimaran, off-the-beach sailboats, for example, dinghies, sailboards, small racing boats, wind-driven iceboats, wind-driven dune buggies and the like. Accordingly, this invention is applicable from large wind-driven mechanical devices, e.g., wind mills and power generators, to wind-driven ships and structures down to the small sailboards and dinghies.

BACKGROUND FOR THE INVENTION

A lifting surface is defined as a surface which, due to the relative motion of a fluid such as an air across its surface, provides a positive force on one of the surfaces which can then be transmitted to the conveyance in form of a motion.

As an illustration of a lifting surface, an aircraft wing is a lifting surface. Likewise a keel on a sailboat is a lifting surface. Sails for boats are most commonly known as pliant lifting surfaces. Typically, the sails on a sailboat are a jib or a Genoa sail, a mainsail, and other sails such as mizzen sails for ketches and yawls. Other sails are trysails, staysails, spinnakers, and various other types where the force imposed by the wind on the sail is borne by a pliant fabric or a pliant plastic and fabric laminate such as a plastic reinforced with a scrim or a fabric (on one or both sides of the plastic sheet). As the sail material bears all the exerted forces, its weave, construction, fabric orientation, and reinforcement aspects are critical.

In order to have a lifting surface of a maximum efficiency such as for a sailboat and especially for a sailboat engaged in competitive racing, it is important that for any given wind conditions the lifting surface is not irreversibly distorted due to the distortion in the pliant material itself such as in the fabric or plastic sheet or plastic sheet and fabric composites.

Hence, the appropriate fabric must be selected for each of the given conditions for which the sail is anticipated to be used. Furthermore, the plastic laminate must also be especially carefully reinforced so that it does not distort beyond a given point. A plastic laminate is generally reinforced with a scrim throughout its entire body or the laminate consists of fabric on either one or both sides of the plastic such as in a sandwich construction.

Typically, before the onset of laminated sails, these were made of a woven fabric. If a woven material is used, the woven material has all the characteristics typically found in such material. That is, the woven material has warp and weft threads. Woven material has poor bias properties. Plastic laminates have better bias properties.

For each type of threads used for a woven material, these may be made of different or the same material. Different threads impart different characteristics to the fabric, such as different tensile strength or failure mode characteristics. In order to accomodate differences in the warp and weft and bias behavior, the fabric is aligned in such a manner as to take the most stress along warp lines, i.e., the lines where the stress is imposed on the sail.

The forces or loads on a sail and its fabric are exerted in a complex manner. These loads may be described by various notations, e.g., as contour lines, or lines of equal forces or load cells exerted on the sail. It must be understood that load lines are approximations and are done for convenience because the force is substantially solely, in the typical prior art sail, transmitted by the pliant fabric. The force is transmitted in an uneven fashion on a sail which is a surface of complex compound curves. For this complex curve surface, it is important that the surface has the right shape, because the maximum lifting efficiency over long periods of time has been developed as an art merely by comparison to a previous sail or a sail with given performance characteristics.

In addition, each of the sails must also have some relationship to the vehicle being driven, such as a sailboat or an iceboat. For the last, because of the tremendous speeds being achieved by these boats, i.e., in excess of 80 mph, sails must have a different shape from one that is typically being sailed at very low speeds, for example, less than five mph.

Moreover, the load distribution on these two lifting surfaces varies considerably. Sailmaking over the past has been an art which has relied on the proper shaping of the various component parts in the sail to obtain the surface. However, it is emphasized that substantially entirely the forces or loads have been borne by the skin, i.e., the fabric that forms the lifting surface.

For ease of description herein, the sail will be designed as consisting of a head, that is, the upper part of it to which a halyard is attached to hoist the sail up the mast or up a head stay. The bottom of the sail is attached at the front part thereof by its tack to the boat; and, at the aft part, the sail is attached by its clew either to a boom or a sheet. These sails may also be free-flying or be carried in a luff groove. Sails may also be attached to a head stay or a mast by hanks or slides, respectively. These are at intermittent positions along the luff of the sail.

A sail has a foot which is the bottom part of the sail and a leech, the aft part of the sail. The part of the sail projecting beyond the straight line between the head of the sail and a clew is called a roach and the line itself a roach line. The part short of the roach line is called a hallow. The sail curvature or projection between any point on the luff and a roach (parallel to the water) is called a camber. Further, the aspect ratio of the sail is expressed for a triangular sail as the height (or length) of the sail squared divided by the sail area of the sail. Aspect ratio is an important consideration for modern racing sails.

The aerodynamic force on the sail is expressed generally as:

$$F=0.00119\times v_a^2\times S_a\times C,$$

where F is the aerodynamic force in pounds, $v_a$ is the velocity of the apparent wind in feet per second, and $S_a$ is the sail area in square feet. C is the aerodynamic force coefficient for a given sail.

Expressed in another manner, for a full-size sail the force is referred to as:

$$F_{tf.s}=C_t\times 0.00119v_a^2f.s\times Safs,$$

where fs stands for full-sized, and $F_t$ stands for total force. The total lift, load, or the force thus are equivalent.

However, each of the sail shapes has its own coefficient $C_t$ and its own load bearing characteristics. The forces are a resultant of the various forces or loads induced on the lifting surface by the aerodynamic flow and drag of air over the surface.

If the force exerted on any particular area on the sail is measured and then the areas which have equal force exerted on these are joined by a line, an equal force contour line on the sail may thus be defined. Appropriately defined increments in the force contour lines will then show the equal force distribution over the surface of the sail.

These contour lines approximate the stresses which are being imposed on the sail, as distorted or further amplified based on the point loads or stresses at boundary supports. At points of loading, e.g., attachment points of the sail, the forces or loads are being transmitted to the rigid structure, such as a sailboat. At these points the loads are especially severe.

These concepts are explained such as by Marchaj, *Sailing Theory and Practice,* Dodd, Mead and Company, New York, 1964. A distribution of the pressure on a sail has been illustrated such as on page 59 of the above-mentioned book.

Because of the very complex compound curves for the sail or the lifting surface, there is very little data available for each of the particular sails. If it is taken into account that the support points or point loads such as the head, the clew, and the tack concentrate the force contour lines, it is seen that the various attachment points have very high stress areas.

For modern high aspect sails, the forces such as at a clew or at a head are very high. Attachment points are strengthened in a traditional sail by reinforcement patches of various constructions and types.

In addition, if sail slides, hanks or reef tacks or clews are further taken into account, it is seen that the force distribution over the surface area is complex.

These forces, of course, as seen from the above formula, vary as the wind velocity varies with the force increasing as a square with each increase in the linear wind speed measured either as feet per second or meters per second or whatever system is being used.

Accordingly, the sail has to accomodate to the best lifting surface conditions by an appropriate shape built into it and appropriate adjustments which are being made to the sail for the various conditions encountered. Thus at any given wind angle of attack the force contours as well as the magnitude thereof will also vary over the sail surface. Hence, the sail coefficient $C_t$ will vary in the above formula. For well-made sails or well-adjusted sails, the value for $C_t$ will be larger than for poorly made sails and poorly adjusted sails.

In general, the three principal directions of sailing in a sailboat based on the angle of attack of the sail vis-a-vis the wind are: beating, reaching and running. The highest load on a sail for a given true wind strength is imposed when the boat is in its beating mode. Hence, the forces are again different based on the angle of attack to the wind. The shape of the sail for each condition must be changed in order to obtain the best lifting surface characteristics.

The lifting surface characteristics are controlled by the sheet tension, the halyard tension, the sheet lead angles with respect to the tack position, the tension on the luff such as may be exerted by a halyard tension or a Cunningham line tension or on the foot, such as may be exerted by changing the sheet lead and/or sheet tension position or the outhaul position (outhaul tension) such as on a boom. Further, sails are often reefed, i.e., sail area and shape are changed, such as by a flattening reef, or a mast is bent to change the shape of the sail to either "up-power" or "down-power" the sail for any given wind condition. Places where the reef points are located must also have reinforcements, and these introduce again different force contour lines when the sail is reefed.

As the adjustments in the various control lines are being made for optimum sailing conditions, the force contour line changes. These force contour lines are affected further as a result of the dynamic loading (as opposed to the static loading) in a seaway or due to the pitching or yawing of the boat and in a gust-and-lull sailing condition. These sail force contour lines, as it is seen, are not static, but move around the surface of the sail and affect the efficiency of the sail and therefore the hull being driven by the sail.

Other factors that influence the sail efficiency are such as mast and standing rigging motion, as well as weight aloft. As it concerns the weight aloft, this matter will be treated further in the discussion of the novel construction disclosed herein.

Still further, the apparent and true wind concept is also of great significance. In boats that often sail in smooth water where the dynamic loading is not greatly affecting speed, large boats or small boats such as iceboats can achieve speeds in excess of the true wind and thus as the wind force increases due to the relative or the apparent wind vis-a-vis the true wind, the forces on the sail increase appropriately as shown by the above formula. This concept is also known by a shorthand expression of "making its own wind", and is especially noticeable for iceboats.

Because a given lifting surface is generally useful over a fairly narrow range, the sail must be constructed for fairly narrow wind ranges and wind conditions.

Consequently, because of the distortions and irreversible distortions when a sail has been overstressed, the restrictions on the wind speed are especially severe when the laminate sails are being used. Laminated sails distort precipitously beyond a yield point and the sail then loses its efficient lifting surface characteristics or is totally destroyed.

As a consequence, modern backing fabrics have been employed to stabilize the laminate film, and the modern laminates consist predominantly of Mylar film with Dacron reinforcements and Mylar film with Kevlar reinforcements. Mylar is a film and Dacron is a fabrich thread material of a polyester polymer. Mylar and Dacron are trademark of the Dupont Company. Kevlar is an aramid polymer, and Kevlar is also a trademark of the Dupont Company. Thus the Dacron and Kevlar fabrics and reinforcements made from these materials have the essential function of stabilizing the laminated sail material as the forces are being imposed on the sail fabric or laminate.

In a similar manner, the Kevlar and Kevlar laminates (aramid polymers and the derivatives of the aramid family) are being increasingly used because the Kevlar material possesses extremely advantageous strength to weight ratios. Reduction of weight aloft is important to reduce the pitching and yawing motion and the dynamic loading of a sail.

With less weight aloft, a boat pitches and yaws less, and therefore has a more efficient forward force. However, the reduction of the weight is at the increase of the risk of distorting the sail. As a result, the trade-offs in these areas become extremely complex and are further exacerbated because the sail is generally, for want of a better description, designed for narrow apparent wind speed ranges of less than 14 mph, from 14 to 22 mph and above 22 mph, and designated as useful for light, medium and heavy air conditions. Hence, sails are conventionally made of an appropriate size and design to accomodate these wind speeds.

Because of the extremely complex interaction of forces, for a full-size sail, stress magnitude calculations, however, are merely approximations. Consequently, appropriate safety factors used are generally expressed as an upper permissible wind speed at which the sail can be used before damage to the sail fabric occurs. Damage generally occurs along the seams of the material in the fabric itself.

As the reduction of the weight is at the increased risk of distorting the sail, the trade-offs in these areas, as mentioned above, become extremely complex and are exacerbated by economic factors because the price of Kevlar-Mylar laminates is comparatively high to the modern fabrics made solely of Dacron fabric with conventional warp and weft yarns. However, the disadvantage of the warp and weft orientation is that these sails have very little bias strength.

This lack of bias strength again translates into distorted sails. For this reason, the laminates of the Mylar and Dacron and Mylar and Kevlar eliminate some of the bias distortions, primarily because the Mylar films have strength characteristics which prevent this bias distortion to a considerable degree.

However, these fabrics have disadvantages, e.g., sails made of Kevlar. Kevlar's flexure properties are considerably poorer compared with Dacron sails. Thus flogging destroys the Kevlar fibers, i.e., fabric, because its flexure life is considerably poorer as compared with Dacron. Moreover, flogging of a sail is especially damaging at high wind speeds. Again, these factors introduce trade-offs where the outstanding strength for Kevlar is at a sacrifice due to its flexure-life properties, i.e., useful sail life.

As a result of the new introduction of the more effective strength-to-weight materials such as Kevlar, there has been a continuous development of sails which ostensibly accomodate the various load distribution in a sail. These attempts are aptly illustrated by the sails shown such as in *Yacht Racing and Cruising,* Vol. 23, No. 11, 1984, captioned *Sailboats* '85. For example, the sails shown on pages 8*a–b,* 149, 155 and 157–9 illustrate the high intensity of the design effort. As it is evident from the various shapes illustrated in this publication, there has been a constant striving to devise a stress or load bearing sail of an improved fabric orientation for the load borne by the skin, i.e., fabric. These attempts have been made by using various fabric characteristics and the various strength properties of the fabric or thread materials.

DESCRIPTION OF THE DRAWINGS AND DESCRIPTION OF THE INVENTION HEREIN

With reference to the drawings where the same items are illustrated by the same numbers and wherein these show the various embodiments of the present invention:

Figure 1:
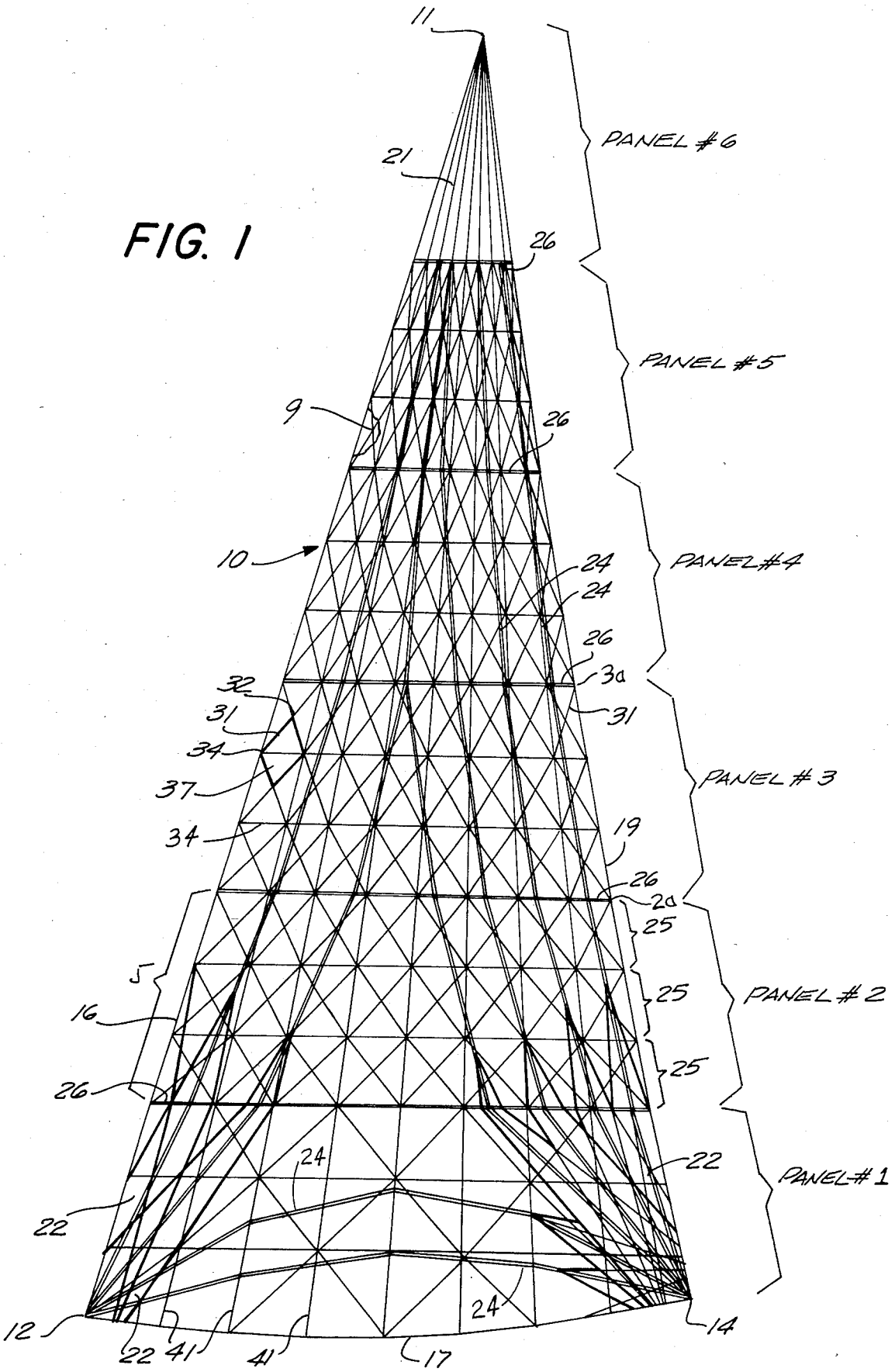
FIG. 1 illustrates in a plan view a typical jib or Genoa sail without its skin members but with structural and grid members according to the present invention.

In accordance with the present invention, the sail 10 shown in FIG. 1 has a head 11, a tack 12, a clew 14, a luff 16, a foot 17 and a leech 19. The sail has head reinforcements shown as 21 which are a number of panels radiating out from the point loads on either one or both sides of the sail and will be further discussed in greater detail.

Similarly, the clew 14 has clew and tack 12 has reinforcement panels 22 of a similar construction.

In distinction from the prior art sails such as illustrated in the above *Yacht Racing & Cruising reference,* the present sail employs a novel construction method as well as employs a novel method for distributing the stress in the sail to obtain a novel article of manufacture. This construction method as well as the stress distribution in a sail results in a new structure which has characteristics far superior to the previous sails as known to the inventor, as well as important advantages for the efficiency, economy, weight distribution and dynamic loading behavior in a sail when it is aloft.

Thus the present invention is predicated on a novel support of the lifting surface, i.e., the sail skin, by incorporating in the sail a number of stress bearing members whereby the skin members functions differently from the prior art sails. As mentioned before, in the prior art the skin fabric itself is the stress-bearing member of the sail. Various embodiments for utilizing the novel stress distribution have been disclosed and will be further discussed herein.

Thus, in accordance with the present invention, the stress-bearing structural members 24 are in the form of strips or ribbons of Kevlar, Dacron or mixture of both. These are shown in FIG. 1 running along the leech, luff and the foot of the sail tending to follow or approximate equal force or load contour lines where the stress is imposed on the sail.

In accordance with the present invention, when incorporated as stress-bearing structural members in the sail, these fabric strips which may be either as a woven fabric or as a monofilament yarns (which are glued together in strip form), or these may also be Mylar-Kevlar laminate strips. These structural members 24 accomodate the point loads as well as support the aerodynamic forces imposed on the other members of the sail such as skin. This results in a force distribution in the sail in a novel and advantageous manner.

The sail thus can be controlled in an improved manner, has a reduced weight aloft which increases its efficiency by reducing the pitching and yawing (or moment of inertia), and contributes to efficient sail control under various wind conditions by appropriately changing the skin curvature of the sail. The skin, of course, on the sail now acts almost like a skin on an airplane wing with the stress-bearing structural members 24 such as in the form of ribbons acting as the support structure for the sail. Consequently, the skin members are not shown but may be indicated substantially as panels 5 or even by a smaller panel 25. These panels 5 or 25 may be constructed in various configurations and may be typically built in the conventional manner and of a variety of panel component layouts. The panels, however, are identified as such and numbered in the drawing.

The novel construction allows then the skin to be built in a considerably lighter weight and with same or different stress-bearing skin memebers. As the skin member arrangement is not shown in the drawings, any skin member arrangement is possible in conjunction with the novel arrangements of stress bearing members to accomodate the stresses at the light, medium or heavy conditions.

Other advantages for the invention reside such as in the ability to vary the weights of the stress-bearing structural members, e.g., 24, i.e., to have these in various widths, thicknesses or denier weights for the threads for the structural members 24. In different parts of the sail, the stress-bearing structural members 24 may be easily curved to accomodate the very complex surface of the sail.

As Kevlar threads are very strong, fabrics made of these will seldom yield even at the most drastic conditions at which a skin load bearing sail would have long distorted.

Moreover, the stress-bearing structural members 24 are oriented in such a manner as to prevent failure mode to propagate through the skin. The skin member, on the other hand, will not distort in the novel sail as it bears little force and is now properly suppported. However, and advantageously, some force or load may be borne by the skin member if it is so desired.

Additionally, the number and the distribution of the stress-bearing structural members 24 and arrangements thereof may be appropriately incorporated in the sail load bearing structure based on the sail's use and the characteristics therefor, such as for the light, medium, and heavy air conditions. However, because of the design of the stress-bearing structural members 24, the sail may have a considerably broader useful operating range as distinguished from the sail where the forces or loads on the sail are carried solely by the fabric itself. Thus the skin members of the sail may also be varied in various weights either for a leech cut sail or a cross cut or typically for the parallel cut members of the sail. Since the skin does not carry much of a load, the skin members may be tailored to suit best the conditions for the particular sail.

It is thus very easy to employ the best characteristics of a skin material, e.g., laminates, without the restrictions imposed by the distortion characteristics of the material.

In addition to the structural members 24 that radiate out of the point load areas such as head 11, tack 12, and clew 14, following or running along approximately the luff 16, foot 17, and leech 19, cross-structural members 26 are used. These cross-structural members 26 represent the panels 5. These cross-structural members 26 are employed to reinforce the sail 10 and aid the structural members 24, tying both together in a load bearing structure.

The extent to which the structural members 24 are incorporated in the head 11 of the sail 10 will be further developed. The reinforcement patches 21 at the head of the sail, however, anchor in various design the structural members 24 in the reinforcement patches 21 or 22.

Figure 2:
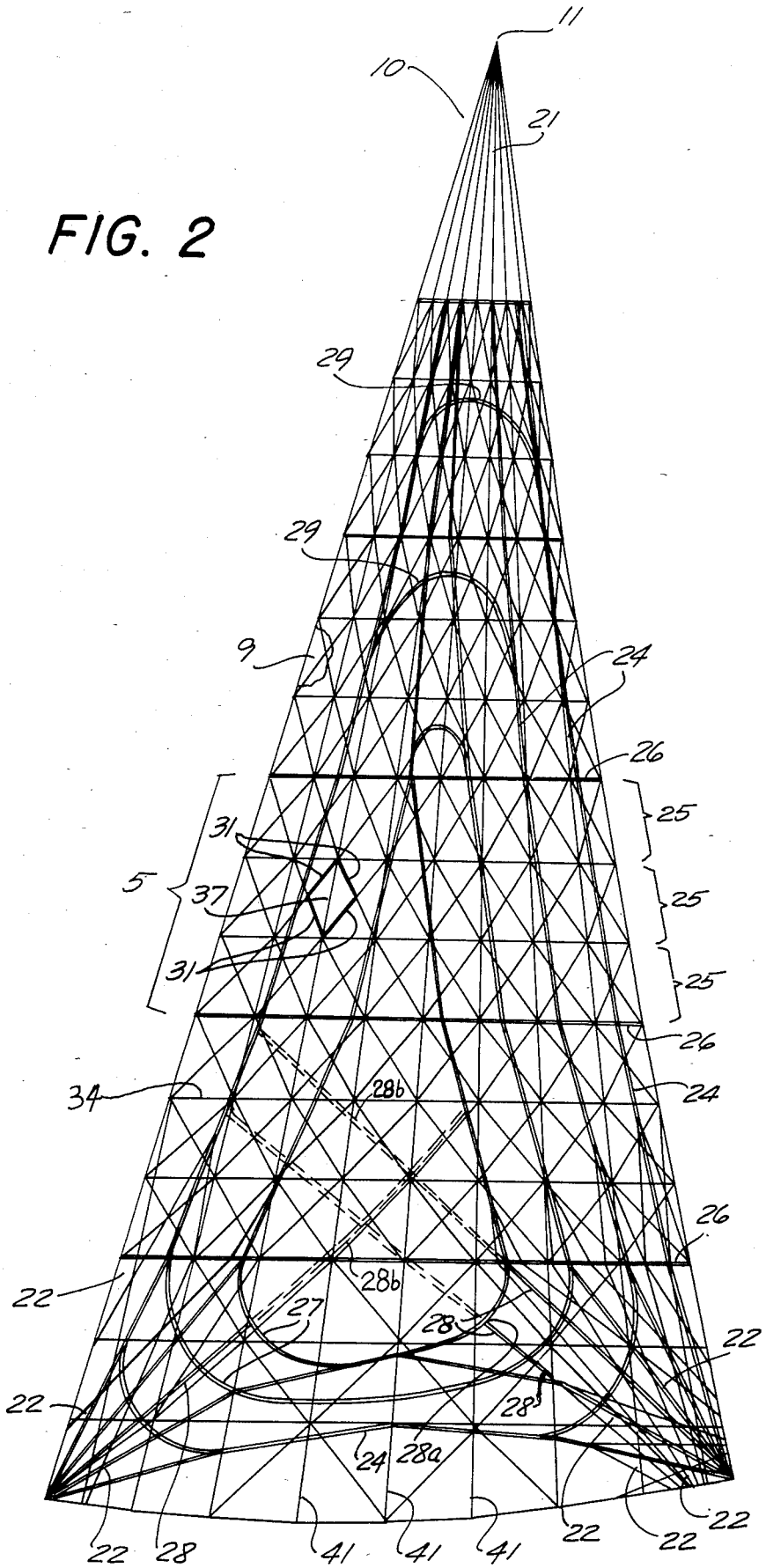
FIG. 2 illustrates in a plan view another embodiment of a Genoa sail according to the present invention.

Before turning to the grid members 31 and 41, the further embodiment describing the structural members 24 and 26 and related derivatives will be shown in FIG. 2 as another embodiment. Thus the embodiment described in FIG. 2 illustrates the structural members 24 being joined by curved members 27. The tack 12 and clew 14 of the sail contain additional structural members 27 and 28 projecting or radiating outwardly from the clew 12 or tack 14. The additional radiating structural members 28 further reinforce the high point load areas of the sail. These radiating structural members 28 have been shown as joined to each of the structural members 24 at appropriate juncture points **28*a* where these intersect the curved members 27. These radiating structural members may be less, equal or greater in number than the structural members 24 shown along the luff 16, the foot 17, and the leech 19 of sail 10. Hence, the number and the relative width of the curved structural members 27 and radiating structural members 28 which join the stress-bearing structural members 24 as depicted in FIG. 2** are illustrative only, but are developed for each wind condition range for each of the sails.

Still further, the radiating members 28 which are further anchored in the curved structural members 27 may be of a greater or lesser length than shown in FIG. 2, and may extend as shown by the dashed lines **28*b*. An additional cross radial curved structural member 29 in the middle and upper part of the sail may be used to introduce further the best suited structural member configurations, again somewhat following the force contour lines. These may be positioned intermediate to the cross structural members 26 which have been shown in FIGS. 1 and 2**.

Figure 3:
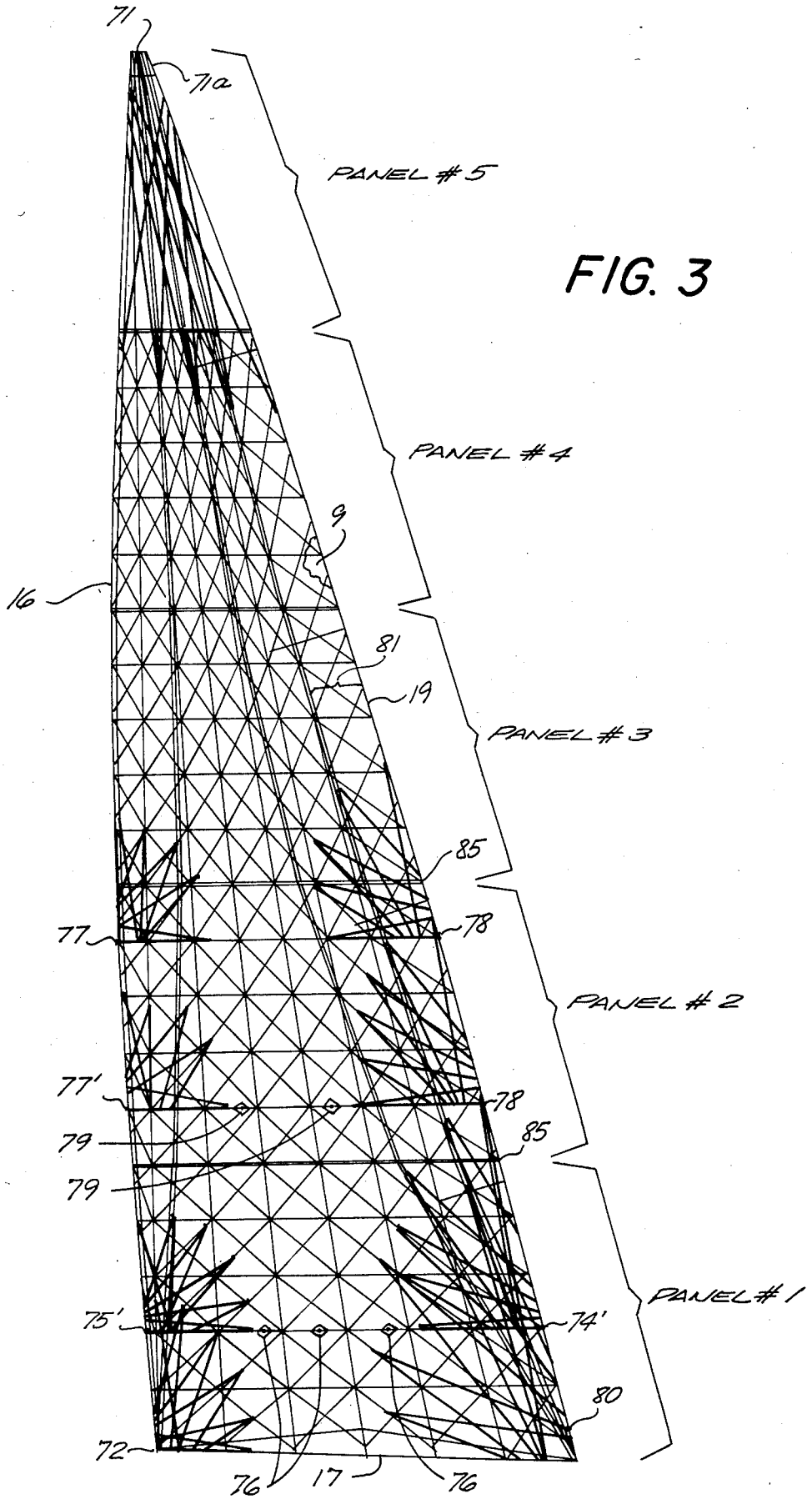
FIG. 3 illustrates another embodiment of the invention for a typical mainsail without its skin member but with structural and grid members according to the present invention.

In the same manner as shown in FIG. 2, the sail shown in FIG. 3 is being constructed, however, in this instance the structural members follow force contour lines which are typically for a mainsail.

For easier understanding of the secondary structural members herein which have been designated as grid members 31, 34 and 41, these will be discussed in conjunction with the manner in which the sail is constructed.

In constructing the novel sail, the following steps are employed. The skin of the sail which is shown by item 9 in FIGS. 1 and 2 is constructed as it is conventionally done in the many varieties known in the art.

Typically each panel is shaped by assembling the skin member subcomponents in a panel and then broad seaming each panel to build into the sail the sail shape desired from foot 17 to the head 11. For luff cut Genoas, appropriately shaped panels projecting to the luff 16 from a clew 14 of the sail 10 are used. The skin members are thus cut in panels to introduce the curved complex shape in the sail 10. Next, on each individual panel 5 appropriate grid marks corresponding to grid members 31, 34 or 41 are placed. This appropriate marking of the grid lines on the sail allows then the proper positioning on the sail of these grid members so as to assure best stress or force-bearing characteristics for each of the particular sails designed for the conditions in which these will be used.

After each of the grid members are affixed to the sail skin 9, such as by gluing or sewing, thereafter the structural members 24, 27, 28 and 29, as required, are laid on each panel of the sail over the grid members 31, 34 and/or 41 to be sewn or glued to the sail skin 9 and grid members 31, 34 or 41.

Typically cross structural members 26 are sewn on last. Each or some of the structural members 24, 26, 27, 28 or 29 may be attached to the sail by an adhesive. Each panel is constructed separately, and each grid member 31, 34 or 41 or structural member 24, 27, 28 or 29 is joined to the next panel, either abuttingly or overlappingly via the cross structural member 26. The cross structural member 26 may be of one or more plies of various widths of Kevlar fabric or laminate.

Thereafter the head, clew and tack patches 21 and 22, respectively are laid on each panel separately and the panels joined together.

In constructing the grid pattern, a latticework is created. The latticework consists of a plurality of grid members 31, defining on skin 9, a diamond 37, shown in FIGS. 1 and 2 with an accentuated line, which are in addition to the skin panels 5 shown again in FIGS. 1 and 2. These skin panels, i.e., 5, may be of greater and lesser width, and are labeled as such, starting at the foot and ending at the head. In FIGS. 1 and 2, no intermediate panels are used and these are merely indicated as a possibility.

Grid members 31 are in these curved lines as shown in FIGS. 1 or 2. These grid members 31 are placed from the luff 16 to the leech 19 of the sail, or from the luff 16 to the foot 17, or from leech 19 to the foot 17 of the sail, separately, but are built for each panel. The placement of grid members 31 may be one-sided or two-sided on the skin 9, that is, these grid members 31 may be laid solely on one side of the skin 9 or alternatively on one and then the other side of the skin 9, and these grid members may then be sewn on the sail panel. The grid members 31 are then finished by appropriate seaming or gluing procedures and incorporated in the panel which has previously been cut.

The previously described structural members 24, 26, 27, 28 and 29 may likewise be incorporated in the sail on one side or other or on opposite side to the grid members 31. Alternatively, the structural members 24, 26, 27, 28 or 29 may be laid on the panel 5, first on one side and then the grid members 31 overlaid on the sail on the other side, or the same side and thereby incorporated therein.

The necessary finishing steps such as cringle (not shown), leech line (not shown), or foot line (not shown) placement are then done.

As it is shown by the above discussion, the advantages of the present invention consist in the ability to provide a structure and an appropriately constructed skin. The structure may be simple as described before or somewhat more complex as shown by the incorporated grid members 31. The grid diamonds 37 provide improved resistance to the aerodynamic load and also distribute the point loads emanating from the boundaries or corners of the lifting surface.

The sail construction thus provides an improvement basically overcoming two severe stresses heretofore borne solely by the skin. One, it provides the resistance to the aerodynamic load, and also provides a resistance to the boundary load or point load emanating from the boundaries and corners.

In addition, the advantages are realised in that less of the very expensive Kevlar laminate needs to be used such as only for the structural members 24, 26, 27, 28 and 29 and grid members 31, 34 and 41. A significant saving is also achieved by the employment of the grid members 31 which allow then the load distribution or the force distribution over the sails, providing for a better shape retention.

Since distortion and shape retention are corelative of each other, it is clear that a lighter sail can be built for a given range of wind conditions or conversely the range of wind conditions can be extended greatly for the same sail.

For example, for a 43 foot boat, the sail construction of the skin is from 3.4 oz. to 4.5 oz. of polyurethane coated Dacron sail fabric (ounces per sailmaker's yard), while the grid members 31, 34 and 41 consist of two inch strips of 400 denier Kevlar laminated to 0.002 inch thick Mylar film; the structural members 24, 26, 27, 28 or 29 consist of six inch strips of 400 denier Kevlar laminated to 0.002 inch thick Mylar film. Obviously various other width and weights of the said component members may also be employed.

In terms of its construction, a sail in accordance with the present invention is most conveniently constructed based on individual panel construction. Thus each panel 5 defined by the structural cross members 26 is constructed separately from the entire sail, and then the sail is assembled by joining each of the panels with the cross structural member 26 indicating both a seam and a cross structural member 26.

Moreover, this technique can be used on any other sail which is being assembled in panels, no matter how these panels are oriented. It is to be noted that most sail assembly is by panels, either what is known as leech-cut panel or a cross-cut panel or any variations thereof. Each of the assemblies employed lends itself to the present method of structural member incorporation, no matter what sail panel construction is being employed.

Referring to the previous illustrations, it is noted that accordingly the sail construction may be in a varied combination of assemblies such as shown in the above-identified *Yacht Racing & Cruising* reference, and the sail thus may be assembled first by forming each panel of the skin member with the structural members placed thereon separately and for each panel, and thereafter the panels joined by the appropriate structural members 24, 26, 27, 28 or 29, or any combination of these.

Cross structural members 26 thus serve two functions, namely—the stabilizing of each of the structural members 24, as well as stabilizing the grid members 31.

In the assembly, as an illustration, for panel No. 3 in FIG. 2, that is, the third panel up from the bottom of sail 10, an appropriate diamond may be constructed of the grid members 31 being overlaid on the sail. However, in any event, the latticework may be varied. While it has been shown here as being in diamond shape for grid members 31, or bisected diamonds when using grid members 34 or subdivided diamonds when using grid members 31, 34 and 41, the latticework may be of various and variegated forms.

These forms may take other load bearing grid shapes best suited for each of the panels or for each particular sail. What is important to remember, however, is that if the sail assembly is by panels, that each of the panel construction must join or be integrated with the adjoining panel. As noted previously, each different sail construction technique or panel assembly technique can thereby be improved with the present stress bearing member support system.

The previously employed sailmaking technique or panel assembly technique may still be used in the construction of the skin, but the stress bearing members such as grid members 31 or load bearing members 24 are overlaid in individual panel fashion on each of the individual panels before the assembly of the same with the cross members 26.

Referring now back to panel No. 3, it is seen that each of the diamonds is formed by overlaying the grid strips in a continuous fashion on the sail only for the length of the panel. The panel thus will have the grid strips formed in the following fashion. Starting from the luff of the sail, a run of the grid strips 31 will be carried out parallel to each other across to the leech of the sail 19. Thus from 16 to 19 the grid members 31 will be placed on the skin panel previously constructed in accordance with any of the methods well known in the art thereon. The illustration of the grid members 31 running from luff to the leech then in the first step will show that the grid members may be begun at either the upper part of the panel indicated as *3a*, or at the bottom part of the panel indicated as *2a*. The grid members 31 therefore will run from *2a*. The *2b*, again somewhat parallel in the curved fashion as shown in the drawings, such as FIGS. 1 and 2.

Thus the grid members are laid on each of the panels being used in the sail construction in the manner such that an appropriate latticework of the load bearing shapes, e.g., diamonds 37, are formed.

As seen in FIGS. 1 and 2, for panel No. 5 towards the head of the sail, the diamonds 37 are considerably more elongated and more closely spaced together.

At the bottom of the sail, such as for panel No. 1, the grid members 31 are further spaced apart, and the grid diamonds are considerably larger.

After the grid members 31, 34 and 41 have thus been laid on the sail at the places indicated for these grid members so that each grid member in the sail will adjoin the grid members in the next adjoining panel, the structural members 24 are placed on the sail. The structural members 24 likewise are placed on each of the individual panels, either with an appropriate overlap so that these can be overlapped between two panels, or these will end with cross structural members 26.

After the panel has been completed, it will be joined to the completed adjacent panel by the cross structural members 26. While these cross structural members 26 are shown of a width somewhat similar to stress bearing structural members 24, the width of the cross structural members 26 may be shaped or widened for each of the panel members as it is desired and as it is based on the stress distribution in the sail. When two panels will be joined at each of the intersection points of members 24 and 26, these will have overlapped joints again forming somewhat of a thicker portion.

Although not shown for either FIGS. 1 or 2, the luff of the sail and the leech of the sail 16 and 19, respectively, may further be enforced by seams such as shown for structural members 26.

This overlapping or joining of the panels 5 may be carried out in such a manner that the stress distribution for each of the panels may be appropriately calculated and appropriate width of the cross structural members 26 may be provided for each of the panels. Thus the grid members 31, 34 or 41 may be considerably wider in one part of the sail and considerably narrower in another part of the sail. The width of the grid diamonds 37 is most conveniently shaped for each of the panels depending on the panel 5 location in the sail. After each of the panels have been joined in the manner as it is commonly done in the sailmaking art such as by broad seaming, that is, by the panels being appropriately preshaped to adjoin the next panel to form the complex structure of the sail, the sail then is assembled further. The construction is then followed in the conventional manner by sewing on appropriate tapes on the luff, leech, and the foot of the sail, and finishing the cringles, etc.

In the construction of the sail as it was described for panel 3, all of the construction details including the corner patches and the corner support members such as 22 are sewn on for each of the panels separately, and all of the construction of the sail is carried out panel by panel. When the panels are joined, however, all of the layout lines such as it has been shown for the grid strips 31 and the structural members 24 are carefully matched and these adjoin, in the proper alignmant, in each of the panels.

The grid structural members 31 are joined for structural distribution of stresses in the form of a latticework or network with the grid members having intersection points of 32. These grid members, e.g., 31, typically are of lesser width than the structural members 24 or 26. These grid members, e.g., 31, may be such as of from 1/5 to about ½ the width of the structural members 24 and 26 or any appropriate ratio thereof.

As it is well known, however, the width of these materials, the size of the latticework, and the variegated form thereof may be appropriately designed to accomodate the various sail sizes and various loads at various locations that are being borne by the sails.

A very large sailboat, such as of a maximum length of about 80 feet, will have structural members 24 of considerable width, whereas a smaller boat will have of smaller size.

All of the intersections in 32 in the construction are glued (or sewn) with an appropriate bonding agent, such as Loctite elastomer bonding instant adhesive or adhesives such as allyl isocyanate adhesives or like. Thus, the integral netlike lattice form is very load distributive.

As shown in FIG. 1, the head panel, i.e., panel No. 6, is conventionally of an entirely Kevlar construction. The panel No. 6 may thus be of various types of construction as encountered in the art such as when using overlapping panels or radiating panels or gores seamed together or with overlapped seams or whatever is being employed by the sailmaker.

The structural members, e.g., 24, may be yoked to a secondary cringle (not shown) at the head of the sail, and anchored in each of the secondary cringles. Thereafter the secondary cringles are joined to the primary cringle (halyard or clew cringle) by appropriate anchoring means such as stainless steel wire or Kevlar strips, again as it is well known in the art.

Typically for the heavy air use, the most vulnerable part of the sail is the head 11 or clew 14 and the construction therefore demands the most heavy reinforcements at the head 11 and clew 14.

According to the present invention, the skin members which have previously carried the loads on the sail need not participate in the load bearing function of the sail. Grid members such as 31, 34 and 41, along with the structural members such as 24, 26, 27, 28 and 29, may be designed to participate entirely or predominantly in the load bearing function of the sail. Although the skin may be appropriately designed to carry a portion of the load, e.g., less than about ⅓ of total load, the proportion of the load that the skin bears versus what the grid members 31 or the structural members 24 bear may be likewise proportioned as best suited in the conditions. In any event, the stress is now distributed in an improved manner.

The aerodynamic load or stress is now distributed over the lifting surface in a netlike fashion throughout the lifting surface by members most capable of bearing the stress imposed on the lifting surface.

The layout by today's techniques is typically done on a computer for each of the panels 5 to facilitate the location of the diamonds 37 and each of the cross points 32, but it can likewise be done rather easily by hand, although it will require considerably longer time.

A typical mainsail has been illustrated in FIG. 3. In accordance with this Figure, the head of the sail has been indicated as 71, the tack of the sail as 72, the clew as 73, the first reef tack as 75, and the first reef clew as 74. The reef points have been indicated as 76. The second reef tack has been indicated as 77, and the second reef clew as 78. Likewise the reef points have been indicated as 79 for the second reef. A flattening reef clew is shown as 80, and the roach as 81.

The construction of this sail is in a manner similar to the jib sail shown in FIGS. 1 and 2. The construction is simplified by the absence of the skin panels which again may be in any conventional form. In the illustration as shown in the drawing, the skin panels may be radiating out of the tack or clew 73, and may be then constructed with a certain orientation along the leech of the sail or the luff of the sail, indicated as 16 and 19, respectively. The roach area for the sail has been indicated as 81. In the construction of the sail, of course, the force lines, as these are shown by the typical contour lines of the force, are exerted on the mainsail and tend to be parallel to the leech and extend into the roach of the sail. Thus the roach area 81 and the leech of the sail is also supported with construction members, including a leech tape running along the edge of the sail or the luff tape shown as 85. Typically, however, the luff tape would tend to have some adjustment to it to make the sail fuller or flatter. The sail is made fuller by releasing tension on the luff 16 or made flatter by increasing the tension on luff 16 or by bending the mast.

The grid lines for the sail have also been shown in the drawing of FIG. 3 and hence may again consist of the grid members 31, 34 or 41, or in any orientation and combination as it is necessary to build each of the separate panels to be incorporated in the sail.

However, again the layout must be such that the grid members 31 intersect the adjoining panel 5 grid members 31 or join with the adjoining panel grid members in such a manner as to form a smooth curve from panel to panel bearing the loads across the span of a diamond 37 such as shown in FIG. 1 and from one diamond to another across the panels. The orientation of the diamonds and their shape and their size will vary from sail to sail. Again, in effect, the grid members 31 and 34, as well as 41, will be laid out in the manner most suited for each of the particular sails. However, in FIG. 3, a grid layout has been shown for one of the panels, namely—panel 3, as indicated on the sail.

The last panel or the mainsail, or panel Nb. 5, is terminated in a headboard for the sail 71*a* which is typically of two aluminum plates holding the sail material between these. These plates are riveted together to form the headboard 71*a*. The details of the construction have not been shown, as these are typically made according to the size specified by a racing rule or best suited for the conditions of a particular sail.

If the grid members 31, 34 or 41 are found to be insufficient, these may be bridged by secondary support grids (not shown).

The stress distribution, as described above, allows now the following benefits. The sail may be considerably lighter with the skin bearing very little load imposed on the sail. Likewise the grid members 31, 34 or 41 may be constructed of heavy load bearing materials such as Kevlar or Dacron or combinations of these. The structural members, e.g., 24, by experience are indicated to be preferably Kevlar materials. The grid members, however, may also be of a less expensive material such as Mylar-Dacron laminates.

The sail as built has a considerably wider useful range for effective performance. Sails built according to the described method can now be used by a predictable factor as close to the maximum limit of the rigid structural members of the boat, such as a mast or its support rigging, thereby providing a "fail safe" escape from rig failure.

Conversely, the sail may be built to accomodate wind ranges heretofore found impossible. The wind ranges, however, are now dictated solely by the boat's heeling moment or sail carrying capacity or the weight of sail desired, rather than the sail's inherent structural load bearing capacity. This allows sail luffing to depower the boat without fear of flogging failure, as the novel sails are believed to be more flogging failure resistant and provide a proper force distribution in the sail. The force distribution is achieved by appropriate location of the various diamond shaped panels which are fully integral with the structural members 24, 26, 27 and 28.

While the discussion previously has been with respect to the two sails mainsail and general or jib sail, various other sails can be likewise constructed. The distribution and the grid or lattice patterns provide the freedom in meeting stress loads on each of the panels and the sail.

The spanning of the skin area of the sail by appropriate grid member construction patterns in latticework arrangements such as a diamond or a rectangular or any other arrangement thus distributes the forces along the constructional members and the grid members in an improved manner bearing the loads that the skin bore right into the points or corners of maximum stress concentration.

The span distances are determinative of the load bearing capability of the grid structure as well as the structural members and the forces or loads as these exist in the various parts of the sail may now be tailored independently of the skin load to take appropriately the total load. Based on the distance, the space, the height or size of the diamond, the distance between the structural members, the frequency of the structural members, the denier size of the structural members, as well as the width of the structural members and the grid strips, optimum structure may now be designed for each sail.

According to the present invention, preferably more than sixty percent of the load is now being borne by the structural members and grid members, but other arrangements may likewise be possible where the load distribution by the structural members and the skin member is according to the particular desire or the particular shape of the sail or the particular usefulness of the sail. These arrangements are again subject to the particular sailmaker's preferences or the sailboat owner's preferences, but the layout and the construction of the sail can now be tailored in infinite varieties in far more predictable manner because no longer the skin, as the load bearing member, dictates the construction technique for the particular sail for a particular wind range. The introduced freedom to sail design frees the sailmaker from a number of prior art construction constraints.

Further, the present constructional techniques as mentioned before may be one-sided or two-sided as the panels are being assembled or as more than one panel is being assembled. This takes advantage of today's adhesive technology. The sail construction still allows the completed sail to be overlaid (if one-sided construction is used) with a further skin member which is merely to smooth out the sail surface rather than to bear any load thereon.

With respect to spinnakers, it may not be necessary to use Kevlar as a structural medium, but a more flexible material such as nylon or Dacron.

What is claimed is:

1. As an article of manufacture, a pliant lifting surface such as a sail, comprising at least one continuous skin member of a plurality of panels, a plurality of flat pliant grid members across said panel and integrally and adheringly with said skin member, said grid members defining a lattice work pattern on said skin member; interconnectingly with adjoining panels, as load bearing members for said lifting surface, a plurality of pliant flat structural members interconnectingly with said panels for load bearing with said skin member and with said grid members, said plurality of structural members, interconnectingly joining said panels and projecting radiatingly outwardly into said lifting surface and securedly into point load locations for said lifting surface and joining together at least two point load locations for said lifting surface.

2. As an article of manufacture, a sail, comprised of at least one continuous skin member of a plurality of panels, including a plurality of corners for said sail as point load locations, a plurality of flat pliant grid members across said panels, said grid members integrally interconnecting with said panels, said grid members defining a latticework pattern on said sail with said latticework interconnectingly adjoining a latticework on an adjacent panel, said latticework pattern interlockingly bearing a load on said sail; a plurality of pliant flat structural members interconnectingly integral with said panels, for load bearing said load along with a load on said skin member and said grid members; said plurality of structural members comprising a plurality of: (a) first set of structural members interconnectingly joining said plurality of panels on said sail, (and b) a plurality of second set of structural members interconnectingly integral with said first set of structural members and securedly radiating out of a boundary point load location and into said sail wherein said second set of structural members also interconnectingly join at least two point load locations of said sail.

3. As an article of manufacture, a sail comprising of a continuous skin member of a plurality of panels including a plurality of point load locations of said sail, a plurality of pliant flat grid members in strip form across said panels, said grid members integrally interconnecting with grid members of at least one adjoining panel, said grid members defining a latticework pattern on said skin member, said latticemwork interconnectingly adjoining a latticework on an adjacent panel, said grid members in said latticework pattern interlockingly bearing a part of a total load exerted on said sail, a plurality of first set of structural members for said said interconnectingly integral with said panels for said sail, said first set of structural members interconnectingly joining said plurality of panels on said sail, a second set of a plurality of sturctural members for said sail interconnectingly integral with said first set of structural members, and securedly attached to said point load locations and projecting outwardly of a point load location of said sail into said sail and wherein said second set of structural members also interconnectingly join at least two point load locations of said sail.

4. The sail as defined in claim 3 wherein the grid members are in a latticework of a diamond shaped pattern.

5. The sail as defined in claim 3 wherein the grid members are in a latticework of an approximate diamond shaped pattern with further grid members bisecting a number of diamonds transversely and longitudinally.

6. The sail as defined in claim 3 wherein the grid members are in a latticework of a variegated shaped pattern.

7. The sail as defined in claim 3 wherein the grid members are in a latticework as means for accomodating a load pattern on said sail.

8. The sail as defined in claim 3 wherein the same is a jib sail.

9. The sail as defined in claim 3 wherein the same is a mainsail.

10. The sail as defined in claim 3 wherein the skin member is of fabric or a laminate in a plurality of panels, said grid members are of a Kevlar fabric and said structural members are of a Kevlar fabric.

11. The sail as defined in claim 6, wherein said variegated shaped pattern is of predetermined size.

12. In a method for constructing a sail and for distributing stress in a sail whereby said sail is capable of resisting dynamic loading, said method comprising:

integrally interconnecting a plurality of skin panels for a sail with a plurality of grid members in a latticework whereby said latticework bears a partial load distributively with a skin member;

integrally interconnecting a plurality of skin panels for a sail with a plurality of structural members and a plurality of grid members in said latticework and a plurality of structural members radiating outwardly from a point load corner of said sail, and securedly interconnecting at least two point load corners of said sail;

integrally interconnecting at least two point load corners of said sail with said structural members along lines of load distribution and along lines of encountered stress in a sail when said sail is in use; and supporting with said structural members a load imparted on said grid members and on said skin members of said sail.

13. As an article of manufacture, a sail, comprised of at least one skin member of a plurality of panels; a plurality of pliant flat structural members interconnectingly adheringly attached to said skin member for predominant load bearing of a load exerted on said sail when said sail is in use, said plurality of flat structural members interconnectingly joining said panels and projecting securedly into a plurality of point load locations on said sail and interconnectingly joining at least two point load locations.

14. The article of manufacture as defined in claim 13 wherein the pliant flat structural members are of an aramid material and said skin member is of a polyester-polyester film laminate.

15. The article of manufacture as defined in claim 13, wherein the skin member is a polyester fabric, an aramid fabric, a polyester-aramid fabric, an aramid material polyester film laminate or a polyester fabric polyester film laminate, and said plurality of pliant flat structural members are of an aramid material.

16. The article of manufacture as defined in claim 13, wherein the plurality of flat structural members are of an aramid material and said flat structural members are projecting securedly into at least two point load locations on said sail, comprising a head for said sail, a tack for said sail, or a clew for said sail.

17. The article of manufacture as defined in claim 13, wherein the same is a Genoa sail of a plurality of panels of a polyester-polyester film laminate with a plurality of pliant flat structural members of an aramid-polyester film laminate or aramid monofilaments wherein said aramid-polyester film or monofilaments are distributed in a flat ribbon-like form interconnectingly and adheringly attached to said skin member, and wherein said plurality of flat structural members interconnectingly join said panels and join a plurality of point load locations comprised of a head, a tack or a clew for said sail.

18. The article of manufacture as defined in claim 13, wherein the sail is a mainsail.

19. The article of manufacture as defined in claim 13, wherein the same is a jib.

20. The article of manufacture as defined in claim 13, wherein the pliant flat structural members are continuous between at least two point load locations.

21. The article of manufacture as defined in claim 13, wherein each of the panels is joined with a flat cross structural member.

* * * * *